US007815795B2

(12) United States Patent
Parks et al.

(10) Patent No.: US 7,815,795 B2
(45) Date of Patent: Oct. 19, 2010

(54) POOL SKIMMER ADAPTER

(76) Inventors: Mark Parks, P.O. Box 720069, Pinon Hills, CA (US) 92372; Garasich John, P.O. Box 1027, Rancho Cucamonga, CA (US) 91729

( * ) Notice: Subject to any disclaimer, the term of this patent is extended or adjusted under 35 U.S.C. 154(b) by 119 days.

(21) Appl. No.: 12/286,987

(22) Filed: Oct. 4, 2008

(65) Prior Publication Data

US 2010/0084325 A1 Apr. 8, 2010

(51) Int. Cl.
*E04H 4/12* (2006.01)

(52) U.S. Cl. ..... 210/167.1; 210/167.12; 210/232; 210/416.2; 4/507

(58) Field of Classification Search ..... 210/167.1, 210/167.12, 167.19, 232, 416.1, 416.2; 4/507
See application file for complete search history.

(56) References Cited

U.S. PATENT DOCUMENTS 3,567,020 A * 3/1971 Whitaker et al. ..... 210/94
4,348,281 A 9/1982 Perry et al.
4,776,980 A * 10/1988 Ruffini ..... 252/513
4,798,670 A * 1/1989 Treene ..... 210/167.1
4,903,351 A 2/1990 Dengel et al.
5,259,076 A 11/1993 Voight et al.
5,392,472 A 2/1995 Maxfield
5,510,020 A 4/1996 Gronlund
5,604,939 A 2/1997 Widener
6,007,714 A * 12/1999 Keith ..... 210/167.12
RE36,913 E * 10/2000 Ferraro ..... 210/167.12
6,811,691 B2 * 11/2004 Woodard et al. ..... 210/232
6,962,660 B2 * 11/2005 Wybo ..... 210/315
6,966,078 B2 11/2005 Evans et al.

* cited by examiner

*Primary Examiner*—Fred Prince
(74) *Attorney, Agent, or Firm*—Lewis M. Brande; Thomas A. McCleary; Brande & McCleary

(57) ABSTRACT

This invention describes a ring shaped adapter that is adapted to fit within a pool skimmer and have a pressure cap that will prevent debris from inadvertently being deposited within the pump system of the pool under construction. The ring shaped adapter and pressure cap will allow the pool to be drained using the pump system, without any additional equipment.

13 Claims, 6 Drawing Sheets

POOL SKIMMER ADAPTER

BACKGROUND OF THE INVENTION

1. Field of the Invention

The present invention relates to the field of Pool Skimmers that are used in the pool industries. The closure assemblies have generally been used for pool maintenance and closing the swimming pool skimmer for winter (winterizing).

The field of endeavor for this invention is directed towards in-ground pools. The reason for this discrimination is that the pool skimmers common in the industry have dual conduits. Generally the dual conduits are required by either state or local municipal codes. One conduit is connected to a main drain piping, which is located at the bottom of the pool, the remaining conduit is connected to the pump piping system.

When the pool is initially built, and the plumbing has been placed into position, it is inspected by the municipality to assure that there are no leaks, and the pool plumbing is able to withstand the maximum pump pressure. In order to check the system, two pipes are screwed into the bottom of the skimmer, and a pipe is attached to the tops of the two pipes, which makes a sealed connection to the main drain. The two pipes will remain attached to the pool skimmer until the pool is completed in order to prevent any rocks or other debris from collecting at the bottom of the plumbing, which would cause an operational problem with the pump or drain system.

After the pool has been completed, the pipes will be removed, which will allow the skimmer cover to be placed into position.

2. Description of the Prior Art

U.S. Pat. No. 4,281,422 by Simonelli discloses a winterizing kit that includes a socket plug that fits into a female receptacle of a filtered water inlet. The socket plug includes a check valve and a nipple to impede the flow of water from the swimming pool and also disconnect an air compressor attached to the pool water line.

U.S. Pat. No. 4,825,605 by Weir discloses a closure device for pre-formed wall openings in swimming pool side wall panels that includes the insertion of either rectangular or circular-shaped plugs into the wall openings. The plugs are used to close unwanted openings in the wall of the swimming pool. The plugs are attached to the side wall of the pool.

U.S. Pat. No. 4,903,351 by Dengel et al. discloses a winterizing faceplate kit for the side wall of the swimming pool. The kit includes a cover plate, faceplate, and a pair of gaskets, where the cover plate is adapted to be removable and be secured to the sidewall facilitating spring season opening and fall season closure of the swimming pool U.S. Pat. No. 4,285,358 by Hodak discloses a sealing assembly similar to U.S. Pat. No. 4,903,351 by Dengel and includes a gasket frame, faceplate and a cover panel which are all attachable to the inside surface of a pool wall in order to shut the water flow from the pool to the skimmer.

What is needed and has never been disclosed or described is an apparatus that will have the ability to seal the skimmer from the side drain of the pool, but still allow communication between the pool pump and the main drain through the fittings that are attached at the bottom of the skimmer.

SUMMARY OF THE INVENTION

The present invention discloses a conventional swimming pool skimmer that is known in the art for many years and has been adapted to receive a pressure cap. The cap has been designed and adapted to be inserted into the bottom portion of the skimmer below the side drain inlet for the pool or throat.

The cap may be threaded or may use another standard form of attachment to the skimmer. Generally the swimming pool skimmer housing will be adapted to receive a reduced diametrical section that will allow a cap plug, or seal ring to be attached near the bottom of the swimming pool housing below the bottom of the debris basket, but still provide a gap to allow water from the main drain port to maintain a constant fluid communication with the port to the pump system.

It is therefore an object of the invention to provide a simple device to provide a easily removable pressure cap for the swimming pool skimmer that will allow the main drain to be in direct fluid communication with the pump system.

Another object of the invention is to provide a cap that will prevent any small granular debris like sand or dirt from the pool worksite from entering the pump system, and allow the debris to easily be removed.

It is a third object of the invention to provide the same skimmer cap to eliminate the need to provide elongated threaded pipes to be inserted into the skimmer for the local municipality leak test, which will eliminate broken or stuck risers, and eliminate most of the calls to the pool construction site questioning the temporary installation of the risers during construction.

A fourth object of the invention is that the insertion of the plug into the skimmer will prevent the pump from burnout when the water level drops below the skimmer.

Another object of the invention is when there is a freeze, specifically in the midwest and northern states, it will still be possible to drain water from the main drain, even if there is ice covering the skimmer.

Another object of the invention, is the elimination of the requirement for a sump pump to drain the pool, which also implies that there are no electrical connections near the pool water site.

Another object of the invention is to assist in winterizing the pool by inserting the plug into the skimmer and draining the pool water.

A further object of the invention is that the threaded plug may be used to assist in extinguishing fires by using the pool water in the states that are prone to wildfires such as in California.

BRIEF DESCRIPTION OF THE DRAWINGS

Figure one shows a cross section of the pool skimmer attached to an inground pool.

Figure two shows a rear view of the pool skimmer.

Figure 1:
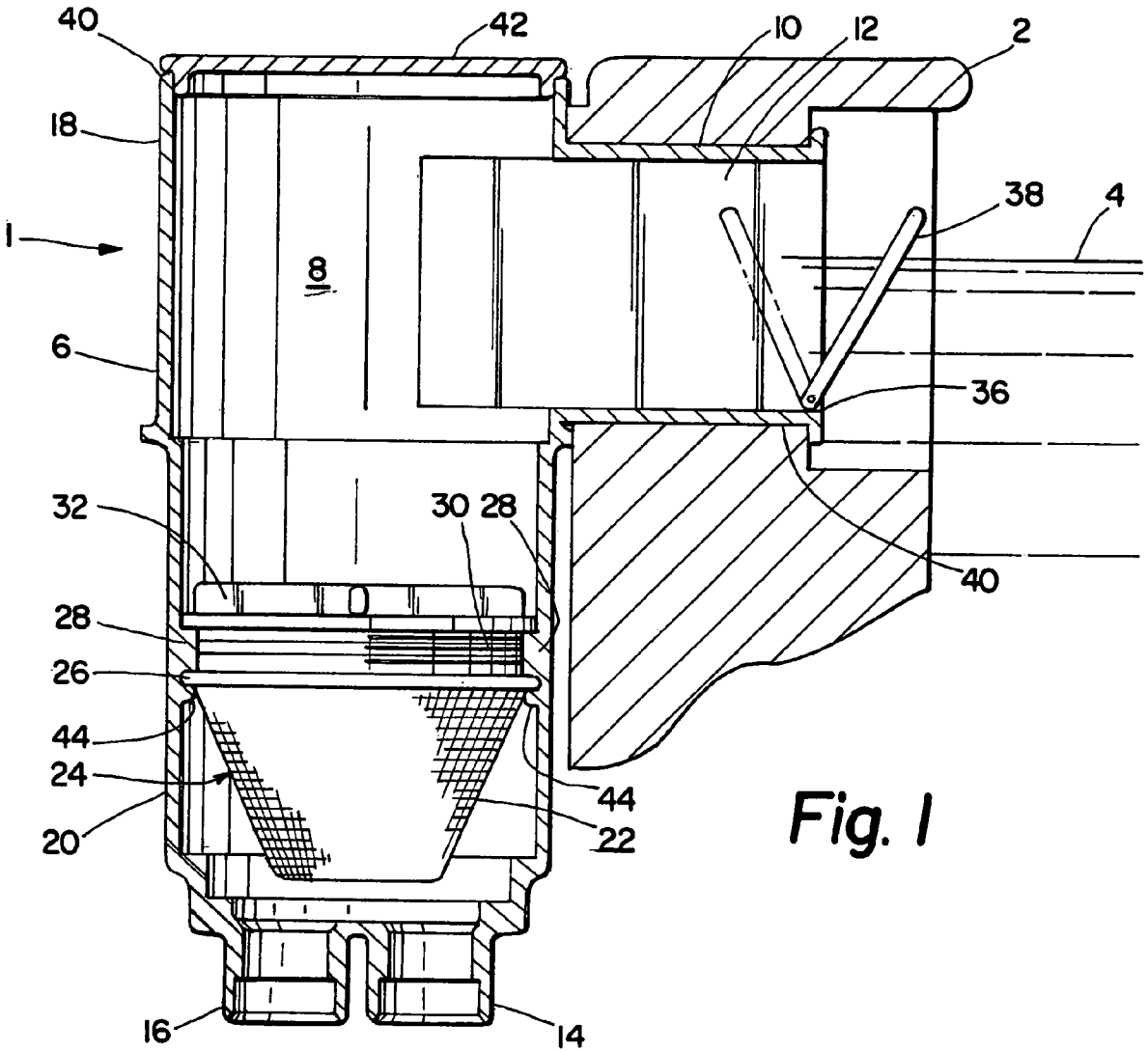
Figure 3:
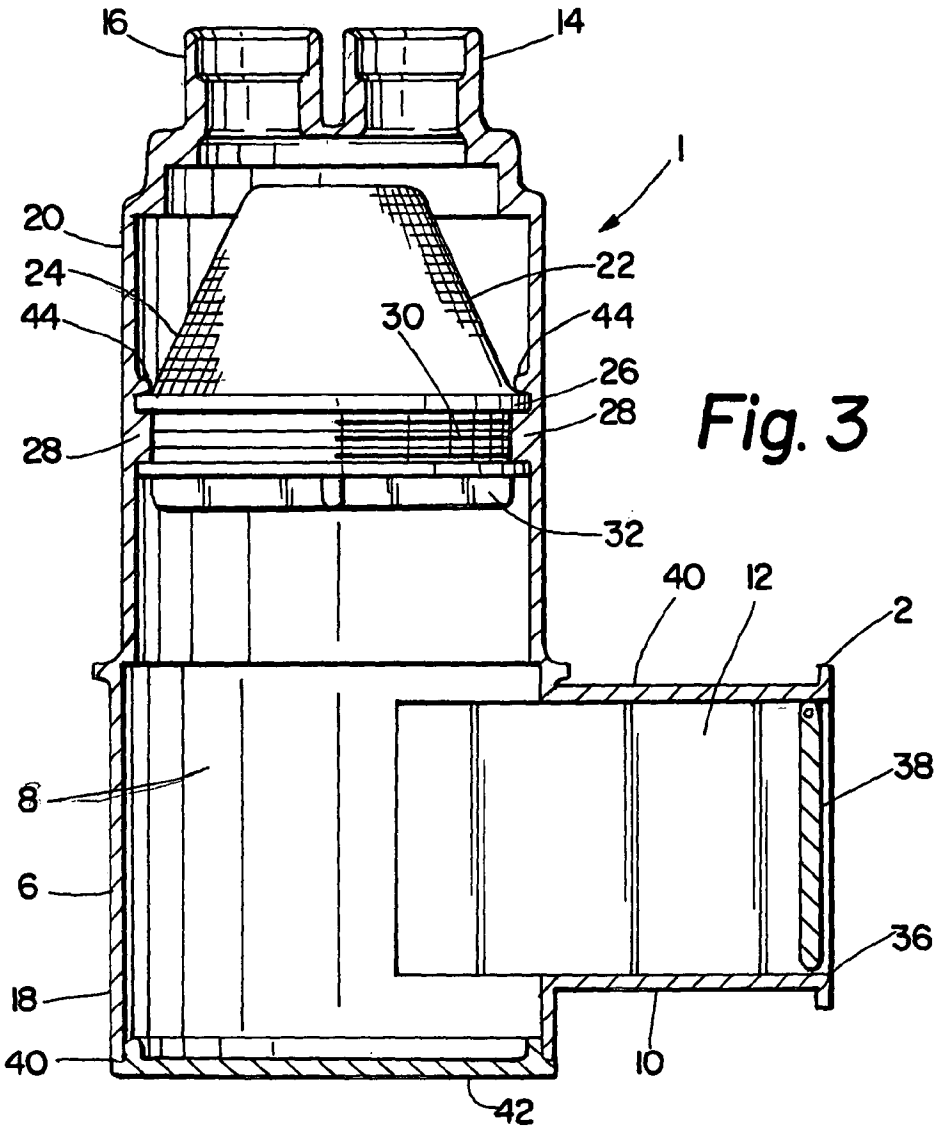
Figure 2:
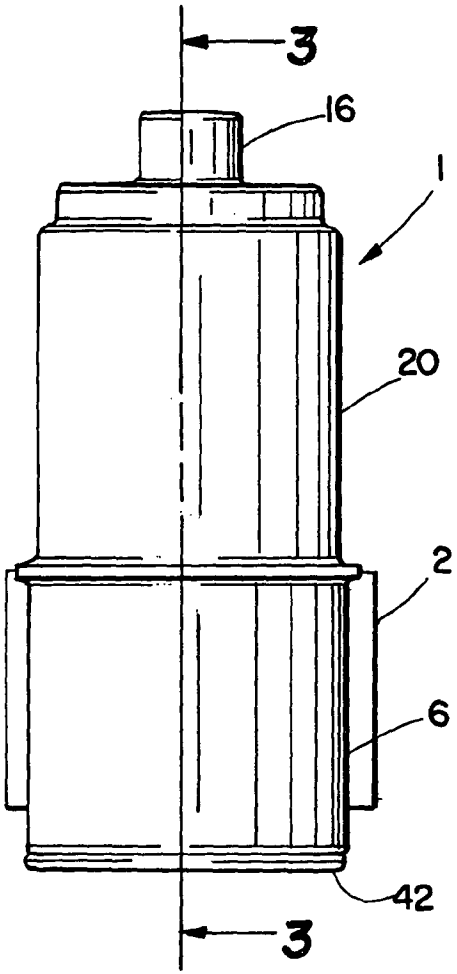
Figure 5:
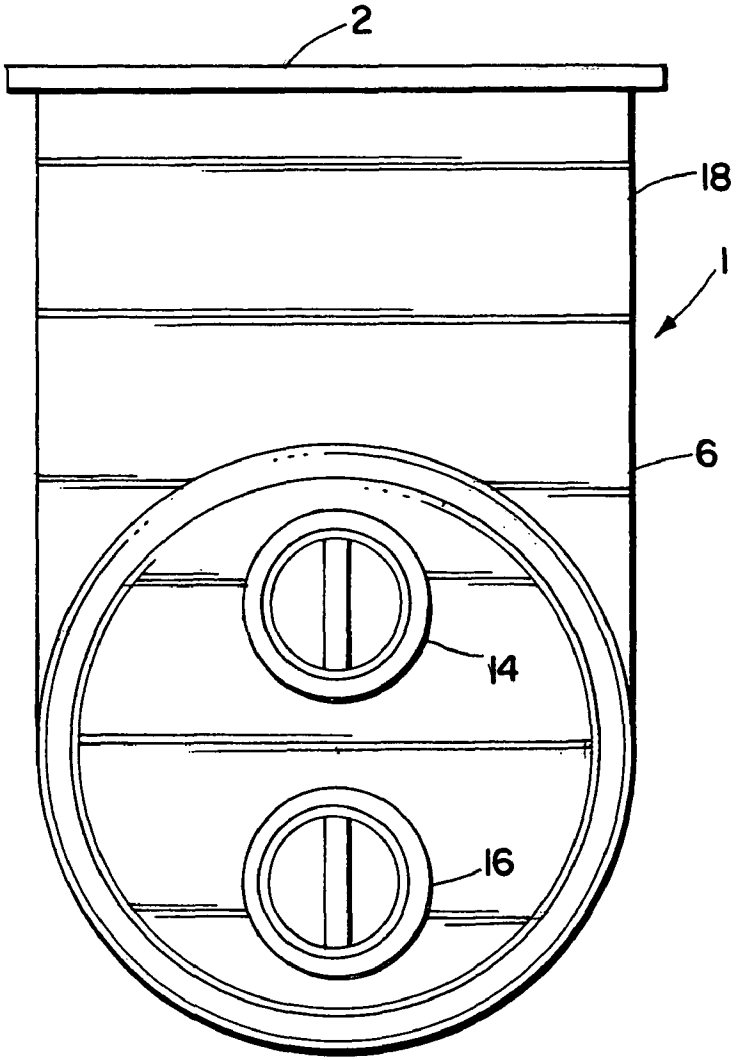
Figure 4:
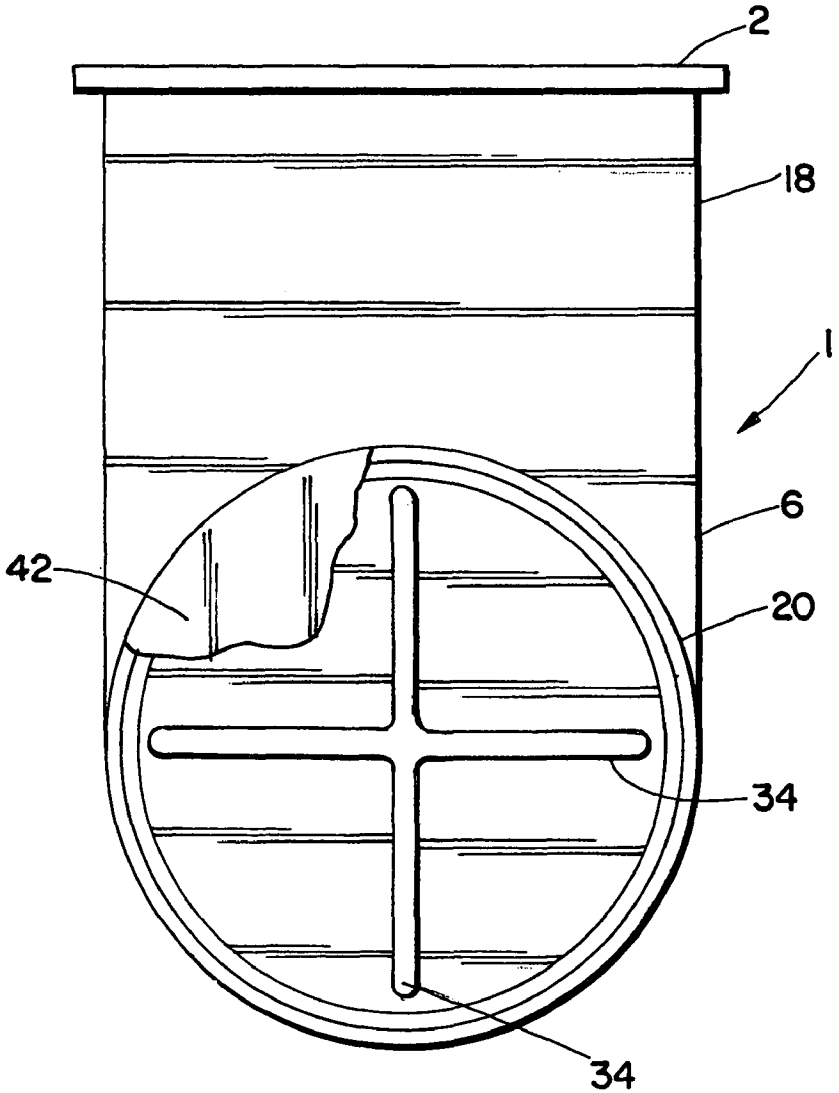
Figure 6:
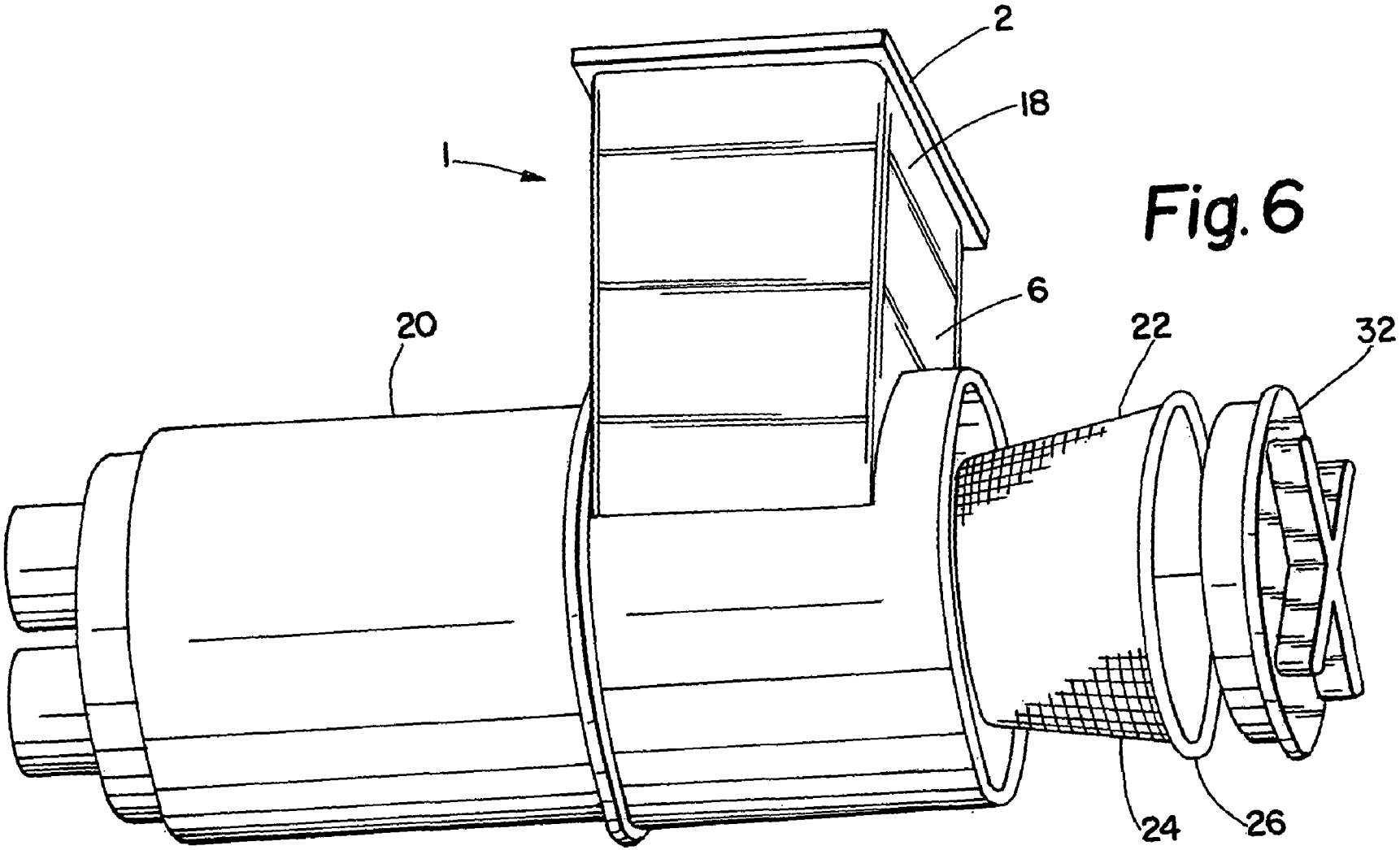
Figure 7:
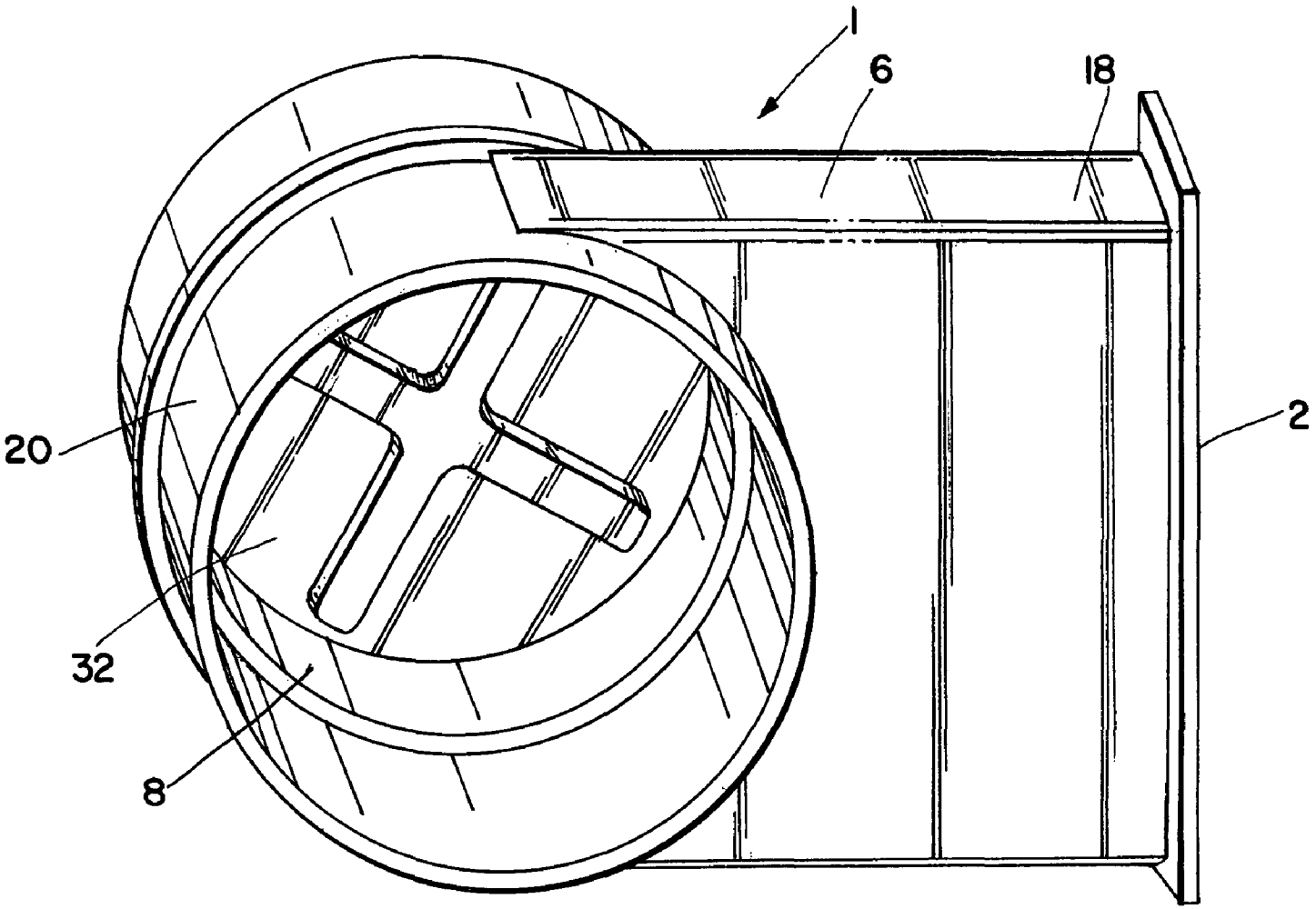
Figure 8:
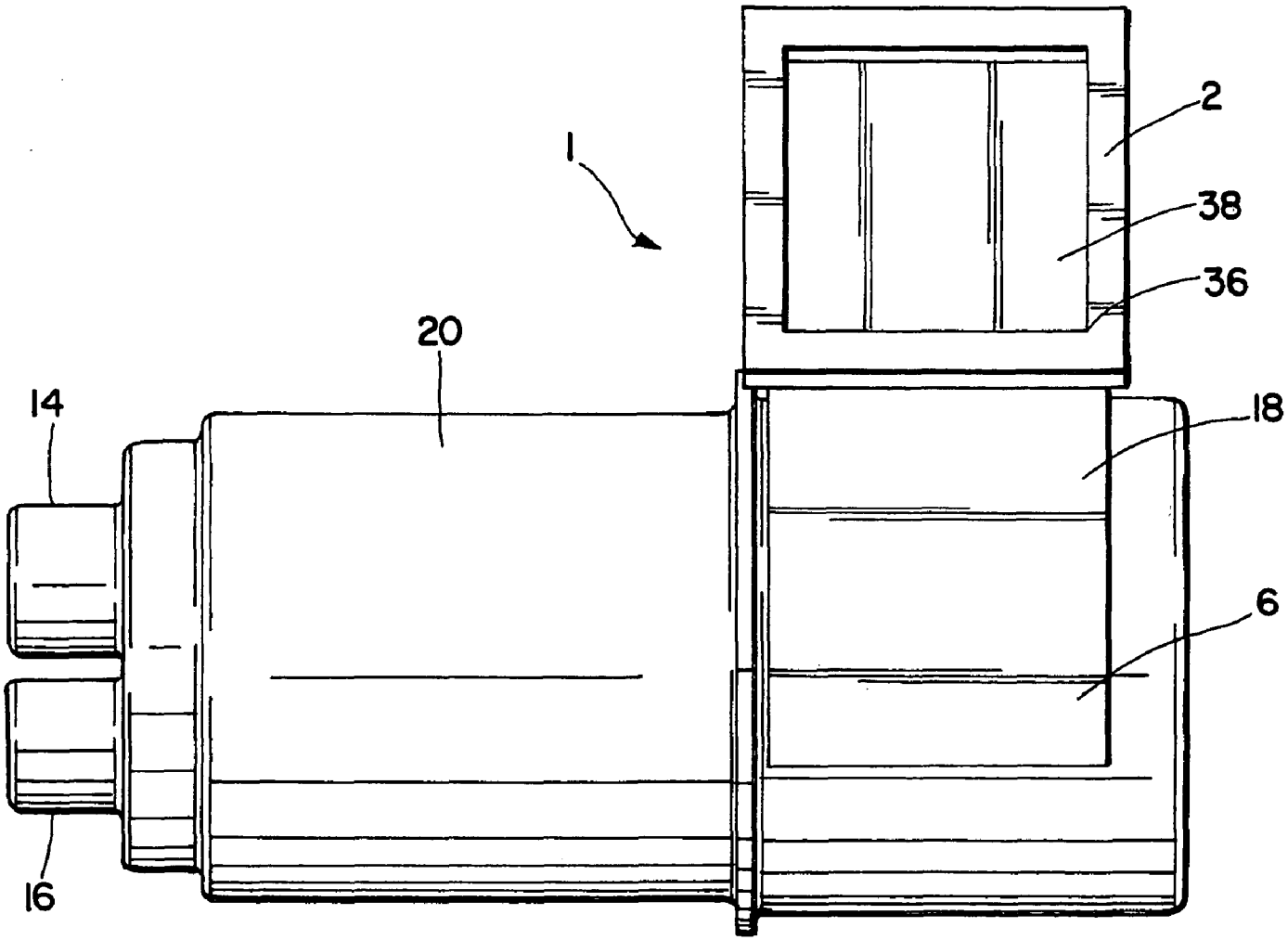

Figure three shows a cross section of the pool skimmer.

Figure four shows a view looking at the drain portion of the pool skimmer with a drain plug installed.

Figure five shows a view looking at the drain portion of the pool skimmer without the drain plug.

Figure six shows an exploded perspective view of the pool skimmer with the drain plug installed.

Figure seven shows a perspective view looking down with the drain plug installed.

Figure eight shows a side perspective view of the pool skimmer showing the throat of the skimmer.

DETAILED DESCRIPTION

Figure one (1) shows an environmental view of an industry standard pool skimmer (1). The pool skimmer (1) is common within the industry of swimming pools, and differs in generic shapes between the various manufacturers of pool skimmers, based upon the manufacturer's specific design criteria. The pool skimmer (1) is shown imbedded in the side of a pool (2), where the water line (4) is shown depicting the water level which allows the water to flow into the pool skimmer (1) and hence be drawn into the pump system. The pool skimmer (1) is comprised of a body (6), where the body (6) may be composed of multiple components either solvent welded or glued together. The body (6) of the pool skimmer has a centrally located hollow portion (8). The body also has a throat (10) attached thereon, where the throat (10) projects outward from the body (6) and provides a direct conduit from the pool (2) to the hollow portion (8) of the pool skimmer (1). The throat (10) has a large central through opening or mouth (12) that allows the water in the pool (2) and communicates with the hollow portion (8) of the body (6).

The body (6) has an upper portion (40). The pool skimmer (1) is provided with a lock down lid or cap (42). The cap (42) is generally lightly press fit, with also a light snap to secure the cap (42) from easily being dislodged from the upper portion (40) of the pool skimmer (1).

As can be seen in FIG. 1, the pool skimmer (1) comprises an upper portion (18) and a lower portion (20). The upper portion comprises the throat (10). As is common in the pool skimmer industry, the throat has a front portion (36), where the front portion (36) of the throat (10) has a weir (38). The weir (38) is pivotably mounted to a lower portion (40) and biased towards the front portion (36) of the throat (10). The weir (38) has positive buoyancy, and prevents debris from migrating from the pool skimmer (1) back into the pool (2).

The lower portion (20) of the pool skimmer (1), has co-located at the bottom of the pool skimmer (1), a pool drain inlet (14) and a pump outlet (16). The pool drain inlet (14) and pump outlet (16) are internally sized to accept pvc (poly-vinyl chloride) piping, which is common in the pool and garden industry. An additional feature is to externally size the diameter of the pool drain inlet (14) and pump outlet (16) for larger piping, such as 3.0" pvc pipes. The reason for using larger diameter piping is that the newer pumps need a larger diameter pipe to provide increased efficiency due to the higher pump flows generated. As commonly done in the pool industry, the pipes that are either internally or externally attached would be fusion welded or glued into place.

Figure one (1) shows that the pool skimmer (1) is provided with a perforated basket (22). As common in the industry, the basket (22) may be tapered, or may be cylindrically shaped. The basket (22) has an upper portion (24), wherein the upper portion (24) has a continuous outwardly extended flange or ledge (26). The ledge (26) rests upon a correspondingly shaped shoulder (44) placed towards the lower portion (20) of the pool skimmer (1). A ring shaped adapter (28) is placed directly above the basket (22). In order to adapt previously fabricated and/or installed pool skimmers (1), the ring shaped adapter (28) may be threadably engaged into the lower portion (20) of the pool skimmer (1), or correspondingly may be fusion welded or glued into position. This would allow pool installers or poolmen to fix the ring shaped adapter (28) into the pool skimmer (1). The ring shaped adapter (28) may be integrally molded into the lower portion (20) of said pool skimmer (1). Integrally molding the ring shaped adapter (28) into the pool skimmer (1) would be accomplished by revising the tooling at the supplier, and would be done for new components. Providing a ring shaped adapter (28) as a separate component would allow the owner to retro-fit existing pool skimmers (1). The ring shaped adapter (28) has an internally defined through hole (30), where the through hole (30) has means to secure a pressure cap (32). Generally the means to secure the pressure cap (32) would be by threadably attaching the pressure cap (32) to the adapter (28), or by providing a pin and groove system common in many industries, to secure the pressure cap (32) to the adapter (28). The pressure cap (32) has at least one raised boss (34), the raised boss(s) (34) providing a grip surface to the pressure cap (28) and allowing a user to easily install or remove the pressure cap (32) from the pool skimmer (1).

The external construction of the pool skimmer (1) is generally defined by the specific company fabricating the pool skimmer (1). They attempt to provide improved fixity to the gunnite or concrete by creating some form of ribbing that aids in adhesion. This invention does not revise the external ribbing of the pool skimmer (1)

What is claimed is:

1. A pool skimmer comprising:

a. a body, said body having an upper portion and a lower portion said body also having as centrally located hollow portion defined therein, a throat, said throat projecting outwards from said body, said throat providing a direct conduit from a pool to said hollow portion of said pool skimmer;

b. said throat has a large central through opening or mouth, said mouth allowing water in the pool to communicate with said hollow portion of said body;

c. a weir, said weir being pivotably mounted in said throat, said weir being biased towards a front end of said throat, said weir further having positive buoyancy, preventing debris from being drawing back into the pool;

d. said lower portion of said pool skimmer has, co-located at the bottom of said pool skimmer, a pool drain inlet and a pump outlet, said pool drain inlet and said pump outlet being internally sized to accept industry standard pvc (poly-vinyl chloride) piping;

e. said pool skimmer is provided with a perforated basket, said perforated basket has an upper portion, said upper portion is provided with a continuous outwardly extended flange or ledge, said outwardly extended flange mats upon a correspondingly shaped shoulder, said shaped shoulder being biased towards said lower portion of said pool skimmer;

f. said pool skimmer is provided with a ring shaped adapter, said ring shaped adapter is biased towards said lower portion of said pool skimmer and is located directly above said perforated basket, said ring shaped adapter is provided with an attachment means, said attachment means fixing said ring shaped adapter to a desired location in said pool skimmer, said ring shaped adapter has an internally defined through hole defined therein, wherein said through hole has means to secure a pressure cap; and g. said pressure cap has at least one raised boss, said raised boss providing a grip surface to said pressure cap allowing a user to easily install or remove said pressure cap from said pool skimmer.

2. The pool skimmer of claim 1 wherein said attachment means to fix said ring shaped adapter is adhesive.

3. The pool skimmer of claim 1 wherein said attachment means to fix said ring shaped adapter is fusion welding.

4. The pool skimmer of claim 1 wherein said attachment means to fix said ring shaped adapter is to integrally mold said ring shaped adapter into said pool skimmer.

5. The pool skimmer of claim 1 wherein said means to attach said pressure cap to said ring shaped adapter is to provide external threads on said pressure cap, said ring shaped adapter is provided with internal threading allowing said pressure cap to threadably attach to said ring shaped adapter providing a pressure seal.

6. The pool skimmer of claim 1 wherein said attachment means is a pin and groove system to secure said pressure cap into said ring shaped adapter.

7. The pool skimmer of claim 1 wherein said pool drain inlet and said pump outlet are externally sized to allow for larger diameter piping.

8. A pool skimmer, said pool skimmer being adapted to receive a ring shaped adapter, said ring shaped adapter being positionally biased towards a lower portion of said pool skimmer, said ring shaped adapter being positioned above a perforated basket, said perforated basket being common in the industry, said ring shaped adapter having a centrally defined hole defined therein, said centrally defined hole providing a means to attach a pressure cap thereon.

9. The pool skimmer of claim 8 wherein said means to attach said pressure cap to said ring shaped adapter is to provide external threads on said pressure cap, said ring shaped adapter is provided with internal threading allowing said pressure cap to threadably attach to said ring shaped adapter providing a pressure seal.

10. The pool skimmer of claim 8 wherein said attachment means is a pin and groove system to secure said pressure cap into said ring shaped adapter.

11. The pool skimmer of claim 8 wherein said ring shaped adapter is adhesively bonded to said pool skimmer.

12. The pool skimmer of claim 8 wherein said ring shaped adapter is fusion welded to said pool skimmer.

13. The pool skimmer of claim 8 wherein said ring shaped adapter is threaded to said pool skimmer.

* * * * *